United States Patent [19]

May

[11] Patent Number: 4,921,032

[45] Date of Patent: May 1, 1990

[54] ROMAN SHADES

[75] Inventor: David A. May, Chestnut Hill, Mass.

[73] Assignee: Appropriate Technology Corporation, Brattleboro, Vt.

[21] Appl. No.: 278,786

[22] Filed: Dec. 2, 1988

[51] Int. Cl.[5] ..... A47H 5/00

[52] U.S. Cl. ..... 160/84.1; 160/348

[58] Field of Search ..... 160/84.1, 348, 330, 160/340

[56] References Cited

U.S. PATENT DOCUMENTS

| | | | |
|---|---|---|---|
| 1,066,269 | 7/1913 | Goodfellow | 160/84.1 |
| 1,212,270 | 1/1917 | Smith | 160/84.1 |
| 1,321,800 | 11/1919 | Andress et al. . | |
| 1,407,248 | 2/1922 | Brown . | |
| 1,482,978 | 2/1924 | Edwards . | |
| 1,752,610 | 4/1930 | McSpadden . | |
| 2,667,218 | 1/1954 | Collins | 160/84.1 |
| 3,256,931 | 6/1966 | Oijerholm | 165/46 |
| 3,322,182 | 5/1967 | Palella | 160/344 |
| 3,376,599 | 4/1968 | Singer | 16/87.6 |
| 3,439,725 | 4/1969 | Haimovitz et al. | 160/84.1 |
| 3,443,860 | 5/1969 | Luboshez | 350/263 |
| 3,487,875 | 1/1970 | Shukat et al. | 160/84.1 |
| 3,777,800 | 12/1973 | Susoev | 160/84.1 |
| 3,952,788 | 4/1976 | Scholer | 160/84.1 |
| 4,069,857 | 1/1978 | Brookshire | 160/84.1 |
| 4,655,272 | 4/1987 | Reilly et al. | 160/348 |
| 4,765,388 | 8/1988 | Dohlemann | 160/348 X |

*Primary Examiner*—Blair M. Johnson

*Attorney, Agent, or Firm*—Wolf, Greenfield & Sacks

[57] ABSTRACT

A Roman shade having spacers for spacing the folds of the shade when in a raised position to provide the raised Roman shade with a cascading effect.

8 Claims, 4 Drawing Sheets

FIG. 2
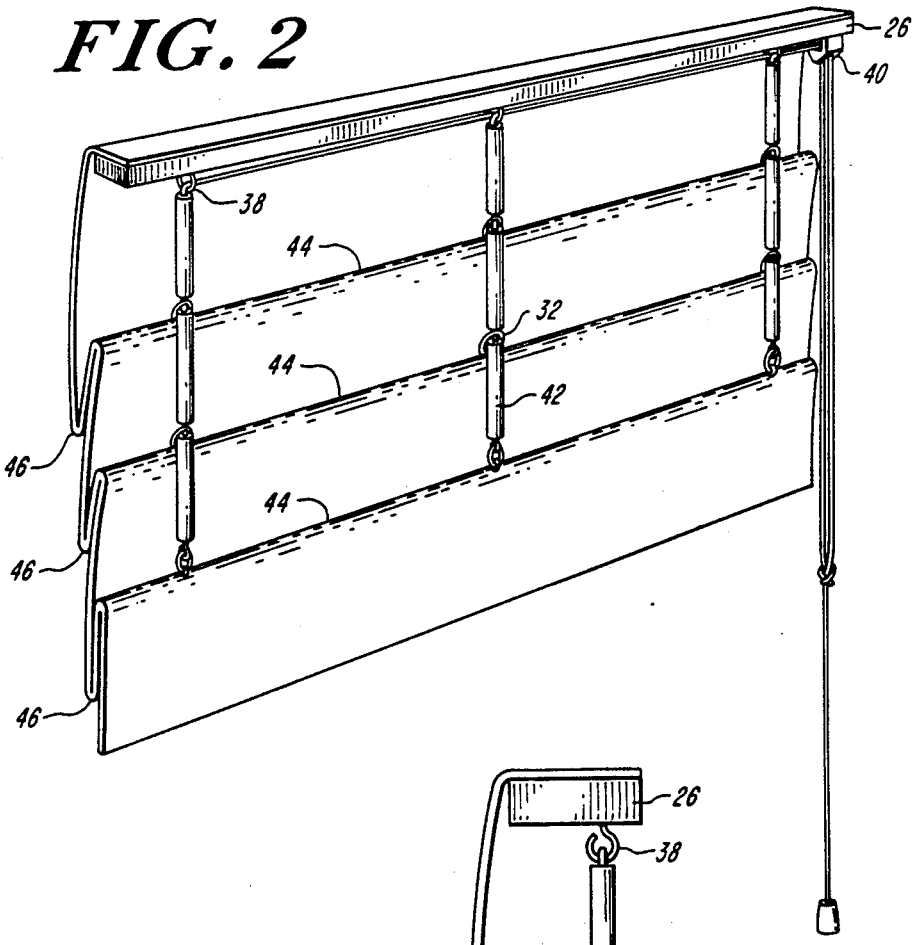
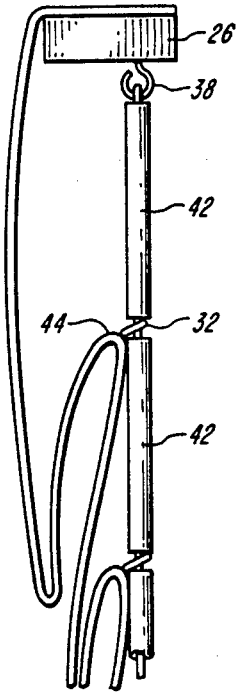
FIG. 3

ROMAN SHADES

FIELD OF THE INVENTION

This invention relates generally to window shades, and more particularly to Roman-style shades.

BACKGROUND OF THE INVENTION

Drapes or curtains generally referred to as "Roman shades" are well known in the art. All such prior art shades are constructed so that when they are raised, they gather from below in generally horizontal folds or pleats until the entire shade resides near the top of the window. The shades are operated by pulling on various lines which are used in conjunction with guides attached to the shade. Examples of such prior art shades are shown in the following U.S. Pat. Nos.: 1,752,610; 3,322,182; 3,439,725; 3,487,875; 3,777,800; and 4,069,857. Relevant prior art structures are also disclosed in the following U.S. Pat. Nos.: 1,066,269; 1,212,270; 1,321,800; 1,407,248; 1,482,978; 2,667,218; 3,256,931; 3,376,599; 3,443,860; and 3,487,875.

Most prior art Roman shades are formed either of a flexible material such as a fabric or of a plurality of panels, and are provided with a plurality of horizontal folds at points vertically spaced from one another to form the pleats when the shade is raised. Vertically extending lines pass upwardly through loops at the top of the shade and then downwardly through loops attached to the backside of the shade. These lines are then secured to the shade at points near the lower edge thereof. Typically, a Roman shade includes two or more lines spaced horizontally across the width of the shade. These lines are gathered together at their free ends to be grasped by the user for raising or lowering the shade. The loops are aligned horizontally along each fold and vertically in columns associated with the lines.

In many Roman shades, when they are raised, the pleats are disposed one behind the other between a front pleat and the window so that only the front pleat is visible from the room. In other Roman shades when raised, the pleats disposed behind the front-most pleat are visible, but the pleats form unevenly and with poor definition. Often the vertical spacing between the bottom of each pleat and the pleat immediately behind it is poorly defined. The result is a shade which is not aesthetically pleasing to many persons who prefer a cascaded appearance.

Previously, several methods have been used to produce a cascaded or pleated appearance in Roman shades. However, each of these prior art methods has a number of disadvantages. In one prior art method, the distance between each successive fold is increased from top to bottom so that the bottom of each fold is visible behind the fold in front of it when the shade is raised. However, this arrangement results in an aesthetically displeasing appearance when the shade is lowered, because the crease marks which form along the folds in the fabric are spaced at increasingly greater distances along the shade moving from top to bottom. In another prior art method, flaps are permanently sewn into the shade fabric or added to it, and these flaps are provided with successively increasing lengths to produce something similar to a cascaded effect. This type of shade looks unsightly when the shade is lowered, and is substantially more expensive to manufacture because of the addition of the flaps.

It is therefore an object of this invention to provide an economical Roman shade which gathers when raised to provide a pleasing, cascading effect.

It is also an object of this invention to provide a Roman shade which is cascaded when raised and which is aesthetically pleasing when raised or lowered.

SUMMARY OF THE INVENTION

The foregoing and other objects of this invention are achieved in the Roman shade of this invention which lies flat when lowered, and which is deployed in a series of defined pleats which are spaced vertically from one another so that they cascade one behind the other when the shade is raised. The Roman shade of this invention typically is formed of an insulating material, although the material need not be insulating. The pleats are defined by a plurality of horizontally extending folds which may be evenly spaced from one another in a vertical direction, or which may have an unequal vertical spacing. Disposed along each fold is a plurality of horizontally aligned connectors, such as rings or loops, through which lines pass which are used for raising the shade. Each of the lines is secured at one end adjacent to the bottom edge of the shade. Each connector on each horizontal fold is vertically aligned with a connector on another horizontal fold through which a common line passes. Spacers are disposed between adjacent pairs of vertically aligned connectors and each spacer has an associated line in its associated column passing therethrough. These spacers should have an outer diameter sufficiently large that they will not pass through the aperture in the connectors adjacent thereto. The lines travel freely through the spacers, so that the shade may be raised by pulling on the lines. Each spacer may travel freely along its associated line, or each spacer may be secured to one or the other of its associated, adjacent pair of connectors between which it is disposed. In an alternative embodiment, the spacers and connectors are integral and each spacer is secured at one end to the shade along an associated fold.

The spacers typically are hollow, cylindrical tubes, although other shapes may be employed. When the shade is raised, the spacers separate the vertically adjacent, horizontal folds by the length of the spacer. Each fold is spaced vertically from the folds vertically above and below it when the shade is raised, producing the desired cascading effect.

The shade of this invention may be formed either of a flexible material, or of a plurality of panels separated by horizontal hinges at the folds. Slats or rods may also be provided at the folds. The shade may be utilized either with a window which is recessed in the frame or with a window which is flush with the frame. If used in conjunction with a recessed window, the shade may also be recessed into the frame and mounted on the recessed surface of the frame. The shade may extend to each lateral edge of the frame and may be provided with flexible edge flaps to more completely seal the window.

DESCRIPTION OF THE DRAWING

The objects, advantages and features of this invention will be more clearly appreciated from the following detailed description when taken in conjunction with the accompanying drawing, in which:

FIG. 2 is a perspective rear view of the shade of FIG. 1 in a raised position;

FIG. 3 is a plan side view of the shade of FIG. 1 in a raised position;

DETAILED DESCRIPTION OF THE PREFERRED EMBODIMENTS

With reference now to the drawings and more particularly to FIGS. 1–4 thereof, a preferred embodiment of Roman shade 10 of this invention now will be described in conjunction with an exemplary window frame 12.

Figure 1:
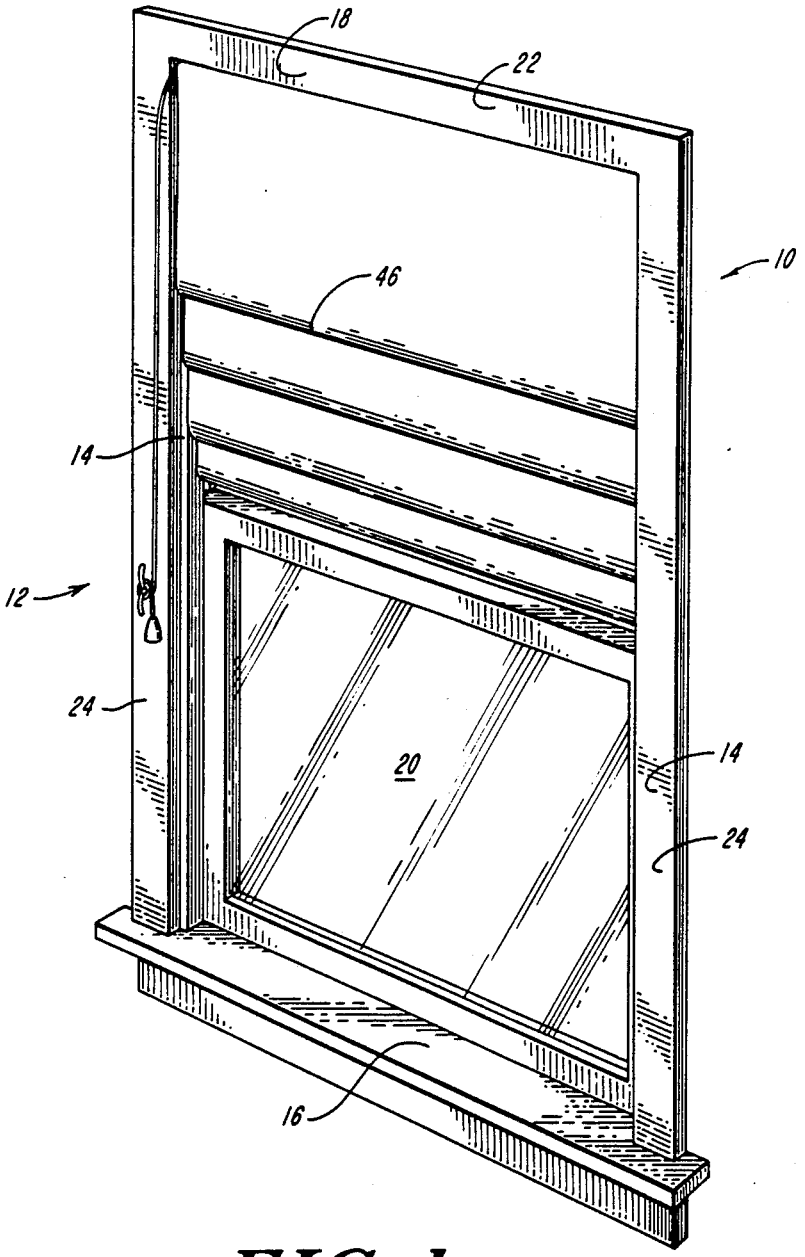
FIG. 1 is a perspective front view of the shade of this invention a raised position shown mounted in a window frame.

Window frame 12 includes vertical sides 14, lower sill 16, and an upper horizontal surface 18 which together define a recess. A window 20 is disposed within the recess. Window frame 12 further includes outer surface 22 which extends horizontally across the top of window frame 12, and vertical side surfaces 24, all of which are disposed outside the recess. In FIG. 1, shade 10 is shown mounted within the recess defined by window frame 12, so that its horizontal width is generally equal to that of the recess within frame 12. However, shade 10 may also be mounted outside of the window frame recess, and shade 10 also may be utilized with a window which is generally flush with the wall. Shade 10 is secured to a support member 26 which extends laterally across window frame 12 between sides 14 within the recess. Support member 26 is secured to surface 18 by any commonly known means, such as by a plurality of screws (not shown).

Shade 10 includes shade fabric panel 30, an array of apertured connectors 32, and a plurality of lines 34. Panel 30 typically is formed of a flexible material, such as a fabric, which may be either insulative or noninsulative in character. The material may be composed of one or more layers; which may be integral or attached together only at connectors 32, as is well known in the art. Panel 30 may also be comprised of a plurality of somewhat rigid panels which are interconnected by horizontally extending fabric hinges. (Not shown)

Connectors 32 are typically rings or loops which are attached to panel 30, such as by sewing or other means known in the art, and which have an aperture 33. Connectors 32 can be formed of any suitably strong and durable material, such as plastic, metal, wood or a cloth material. If vertically spaced, horizontal battens are used, connectors 32 may be threadably coupled to the battens embedded in o attached to panel 30. Connectors 32 are aligned in generally horizontal rows across the width of panel 30. Connectors 32 are spaced horizontally from one another along each row, and the horizontal rows are vertically spaced from one another a predetermined amount. The amount of the vertical spacing determines the vertical width of the folds formed in panel 30 as it is raised. Each connector 32 of each horizontal row is vertically aligned with connectors 32 in each of the other horizontal rows. In this way, connectors 32 are also arranged in a plurality of generally vertical columns which are horizontally spaced from one another. The number of such vertically extending columns is equal to the number of connectors 32 in each horizontal row, and the number of horizontal rows is equal to the number of connectors 32 in each vertical column. In the embodiment shown in FIGS. 1–4, there are three vertical rows, and three horizontal columns of connectors 32. However, it is to be understood that the number of rows and columns shown is exemplary, and that any other number of horizontal rows or vertical columns can be used, as desired.

A line 34 extends along and is associated with each vertical column of connectors 32. Preferably, each line 34 is secured to an associated bottom-most connector 36 in its associated vertical column. Bottom-most connectors 36 are aligned along the lower-most horizontal row. Alternatively, each line 34 could be secured to a bottom rail disposed along the bottom edge of panel 30. Each line 34 passes upwardly from its associated connector 36 along its associated vertical column through each successive connector 32 in sliding relation therewith. Typically, each line 34 then passes through an associated eyelet 38 depending from support member 26 and aligned with its associated vertical column of connectors 32. Each line 34 passes from its associated eyelet 38 generally parallel to support member 26 toward one vertical side 14 of frame 12. All lines 34 pass together through a pulley 40 and thence downwardly from pulley 40 to a securing means 39 disposed on window frame 12. Securing means 39 may be a bracket, a cleat, a cam jam cleat, or any other suitable means for anchoring the loose ends of lines 34.

As panel 30 of FIGS. 1–4 is raised by pulling on the loose ends of lines 34, panel 30 tends to form folds 44 along each of the horizontal rows defined by connectors 32. These folds 44 are identified in FIG. 4 in phantom, and are shown in FIGS. 1, 2, and 3. Folds 46 are formed intermediate folds 44 and depend downwardly from the horizontal rows defined by connectors 32 as shade 10 is raised. Folds 46 are visible along the front of shade 10, facing the interior of the room. Folds 44 are hidden behind the material forming folds 46.

A plurality of spacers 42 is associated with each line 34 in freely sliding relation therewith. The number of spacer 42 associated with each line 34 is dependent upon the needs of the user. Typically, there is one spacer between each vertically adjacent pair of connectors 32 in each column. In addition, typically, there is also a spacer between eyelet 38 and the topmost connector 32 in each column. However, if desired, spacers can be omitted between some connectors 32 in a column, or between eyelet 38 and the topmost connector 32. However, if a spacer 42 is omitted between any two connectors in one column, the same spacer should be omitted between the corresponding connectors in those two rows in all the other columns, so that folds 44 and 46 will hang evenly and horizontally.

Spacers 42 are not permitted to pass through or over adjacent associated connectors 32. Although each spacer 42 is freely slidable on an associated line 34 it is captured between two adjacent connectors 32 in the same vertical column, and located on adjacent horizontal rows. Spacers 42 are of a predetermined length to space the adjacent connectors 32 in each vertical column apart from one another a distance generally equal to this predetermined length of the spacers when the shade is in a raised, folded configuration, as shown in FIGS. 1, 2 and 3. These spacers space each succeeding horizontal fold 44 apart in a vertical direction by this same predetermined distance when the shade is raised, thus producing the desired cascading effect shown in FIGS. 1, 2 and 3. Spacers of different lengths could be used with different rows to produce a variable cascading effect, if desired. However, all horizontally aligned spacers preferably should be of the same length so that the folds are horizontally aligned.

Figure 5:
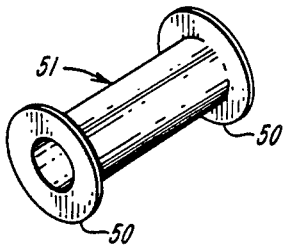
FIG. 5 is a perspective side viewing showing an alternative embodiment of the spacer of this invention.
Figure 6:
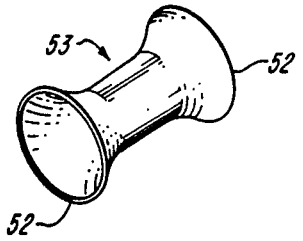
FIG. 6 is a perspective side viewing showing another alternative embodiment of the spacer of this invention.

Typically, spacers 42 are hollow cylinders, although they need not be. In a preferred embodiment, spacers 42 are plastic tubes cut to a predetermined length, through which lines 34 are threaded during assembly of shade 10. Spacers 42 have an outer diameter which is no less than the diameter of aperture 33 of connectors 32, so that spacers 42 cannot pass through apertures 33. Preferably, spacers 42 have an outer diameter just slightly greater than the inner diameter of aperture 33 to maintain the desired precise spacing. In an alternative embodiment, spacers 51 may be provided with flanges 50 at each end as shown in FIG. 5, or spacers 53 may be flared at ends 52 as shown in FIG. 6 to prevent the spacers from passing through or over connectors 32.

Figure 7:
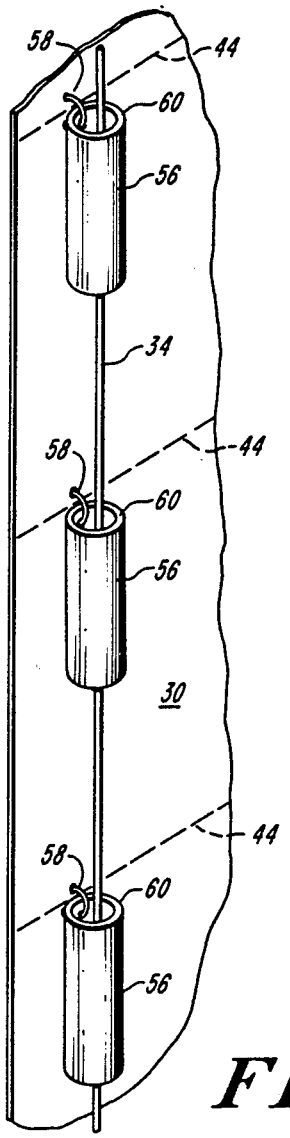
FIG. 7 is a partial, perspective rear view of the shade of FIG. 1 in a lowered position showing an alternative embodiment of this invention.
Figure 8:
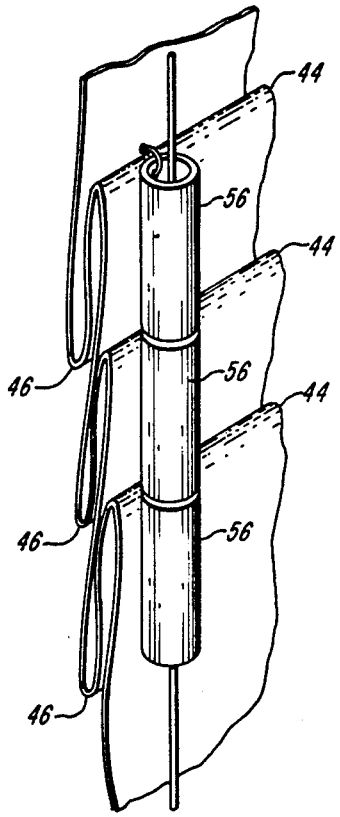
FIG. 8 is a partial, perspective rear view of the shade of FIG. 7 in a raised position.

An alternative embodiment of this invention in which the spacers are integral with the connectors will now be described with reference to FIGS. 7 and 8. Like numbers are used for like parts where possible. This embodiment comprises only spacers 56 and not any connectors 32. Spacers 56 provide the combined function of spacers 42 and connectors 32 as shown in the embodiment of FIGS. 1–4. Each spacer 56 is secured at one end 60 thereof directly to panel 30. Each end 60 of spacers 56 is secured to panel 30 along an associated horizontal fold 44. Spacer 56 may be secured to panel by a ring 58, or by any other conventional means, such as by sewing or by using a rivet, a wire, glue or the like. Ends 60 of spacers 56 are aligned horizontally and vertically in an array as described for connectors 32 to form a plurality of rows 44 and columns, as in the embodiment of FIGS. 1–4. In this embodiment, as the shade is raised, as shown in FIG. 8, successively lower spacers 56 will rise to abut spacers 56 thereabove, providing the desired spacing and a cascaded effect, as described above for the embodiment of FIGS. 1–4. Lines 34 are again disposed in freely sliding relation with spacers 56 and pass therethrough. Spacers 56 are otherwise identical to spacers 42. In a variation of this embodiment of FIGS. 7 and 8, separate connectors and spacers are provided, as in the embodiment of FIGS. 1–4, except each spacer is secured directly to an associated connector at one end of thereof in a known manner to produce a unitary structure.

Figure 4:
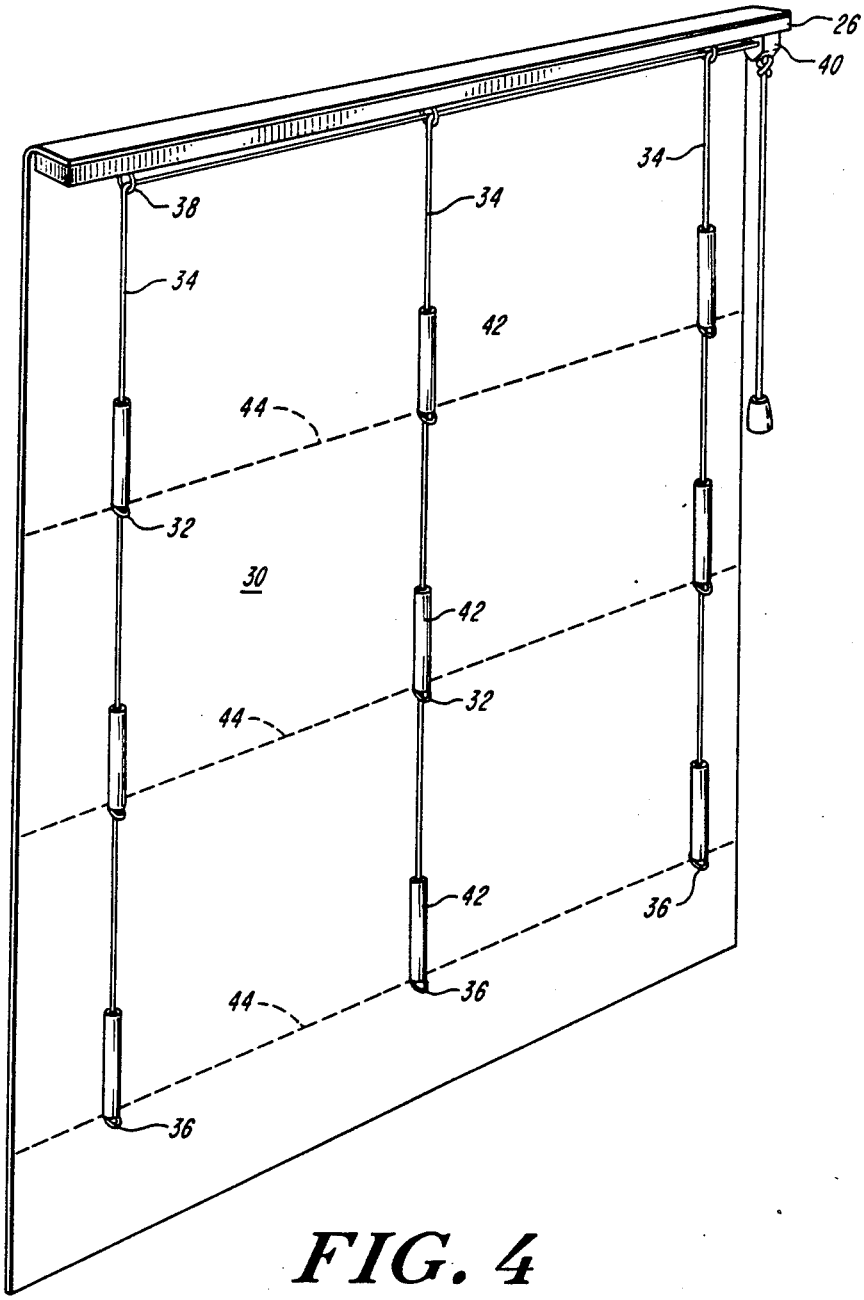
FIG. 4 ia a perspective rear view of the shade of FIG. 1 in a lowered position.

The operation of the shade of this invention using either spacers 42 or spacers 56 will now be described with particular reference to FIGS. 1, 3, 4 and 8. With regard to the embodiment of FIGS. 1–4, typically, due to the influence of gravity spacers 42 tend to rest against the lower of the two connectors 32 between which they are disposed, as shown in FIG. 4. When it is desired to raise shade 10, the loose ends of the plurality of lines 34 are grasped together and removed from securing means 39. A downwardly force is then applied to the loose ends of lines 34, to raise panel 30 upwardly. This force raises panel 30 first at connectors 36, and panel 30 begins to fold along the lower-most folds 44 and 46. The lower portion of panel 30 continues to rise as connectors 36 are drawn toward the lower-most connectors 32 or spacers 56 until spacers 42 abut lower-most connectors 32 or until spacers 56 abut connectors 36. As continued force is applied to the ends of lines 34, this process is successively repeated for the next higher connectors 32 or spacers 56 and folds 44 and 46 until the shade is in its fully raised position as shown in FIG. 3. As can be seen, successive folds 44 are spaced from one another approximately the length of spacer 42 or 56. Folds 44 and spacers 42 or 56 are tucked between the fabric of panel 30 and window 20, out of view to persons in the room. As described, secondary folds 46 are created which are intermediate folds 44 and which are visible from the front within the room. Folds 46 are vertically spaced one below the other to provide the desired cascading effect. The position of folds 46, and the spacing between them, is determined by the length of spacers 42 or 56 and the distance between folds 44. When it is desired to lower shade panel 30, the ends of lines 34 are released, and the process previously described is reversed as folds 44 drop downwardly and folds 46 gradually flatten out under the influence of gravity until the shade is fully extended as shown in FIG. 4.

The provision of spacers 42 or 56 ensures that folds 44 and 46 are always vertically spaced a predetermined distance apart when the shade is raised. This makes certain that successive folds in the shade material are not disposed behind one another, but cascade downwardly from the top in an aesthetically pleasing manner. In addition, each fold 46 is spaced a predetermined distance below the fold 46 just above, to provide geometric precision to the cascade effect. If desired, the lengths of the spacers associated with different horizontal rows of connectors can be varied to provide an increasing or decreasing vertical spacing between successive folds 46. If desired, spacers 42 can be easily removed by disconnecting the lines from connectors 36 and sliding the spacers off lines 34.

The shade of this invention may be used in conjunction with any window that permits the passage of light, including windows in doors, residential windows, windows in commercial and business establishments, and windows in vehicles.

The size, shape and dimensions of spacers 42 or 56 depend upon the dimensions of the window, and upon the type of window for which the shade is constructed. The following dimensions are being provided for purposes of illustration only and do not serve to limit the scope of the invention. In a preferred embodiment, for use with a conventional double-hung residential window for folds 44 that are spaced about six to about sixteen inches apart, spacers 42 have a typical length of about two inches. Spacers 42 or 56 are preferably cylindrical, and have an inner diameter of about one quarter inch and an outer diameter of about one half inch for connectors 32 that have a diameter of about three eighths inch on average. Typically, spacers 42 are tubes formed of a plastic material.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A shade comprising:

a flexible panel having a top edge, a bottom edge and a backside;

means for securing said top edge of said panel to an upper portion of a frame;

a plurality of connectors having apertures secured to said back side of said panel, said connectors being arranged in an array to form a plurality of generally vertically extending columns and a plurality of generally horizontally extending rows, each of said apertures of each of said connectors having a diameter;

a plurality of lines, each of said columns having one line associated therewith, each of said lines being connected to the back side of said panel near its bottom edge and passing through each of the apertures of said connectors in succession in its associated column; and a plurality of spacer means, each spacer means having a predetermined length and being associated with one of said lines passing freely therethrough, each of said spacer means being disposed between an associated pair of adjoining connectors in one of said columns for spacing said adjoining pair of connectors from one another when said panel is in a raised position, each of said spacer means having an outer diameter which is no less than the diameters of the apertures of said associated pair of connectors.

2. A shade as recited in claim 1 wherein each of said spacer means associated with one of said columns has approximately the same predetermined length.

3. A shade as recited in claim 1 wherein each connector associated with one of said rows has an associated spacer means and wherein each of said spacer means associated with connectors in one of said rows has approximately the same predetermined length.

4. A shade as recited in claim 1 wherein each of said spacer means comprises a hollow tube through which an associated one of said lines passes.

5. A window shade comprising:

a flexible panel having a bottom edge, a top edge, a front side facing away from a window, a rear side facing a window;

means for securing said top edge of said panel to an upper portion of a frame surrounding a window;

a plurality of rings secured to said rear side of said panel, each of said rings having an aperture with an inner diameter, said rings being arranged in an array to form at least two generally vertically extending columns and two generally horizontally extending rows;

a flexible line associated with each of said columns, each of said lines passing through an aperture in each ring in its associated column and being secured at a first end to a ring in its associated column which is disposed closest to said bottom edge of said panel, each of said lines being adapted to be grasped at a second end thereof by a user for raising said panel; and a plurality of generally tubular spacers having an outer diameter no less than the inner diameter of the aperture in said rings and having a length, one of said spacers being disposed between each adjacent pair of rings in each of said columns, each of said tubular spacers being slidably disposed with respect to the line associated with its associated column, said spacers each separating said adjacent pair of rings from one another by a distance generally equal to said length of said spacers when said panel is in a raised position.

6. A shade comprising:

a flexible panel having a top edge, a bottom edge and a back side;

means for securing said top edge of said panel to an upper portion of a frame;

a plurality of liens disposed along said back side of said panel and being connected to said back side of said panel near a bottom edge of said panel; and a plurality of spacers, each spacer having a predetermined length and being slidably disposed with respect to one of said lines, at least some of said spacers having one end thereof secured to said back side of said panel but being otherwise unsecured to said panel, said one ends of said spacers being arranged in an array to form a plurality of generally vertically extending columns and a plurality of generally horizontally extending rows, each of said columns having one of said lines associated therewith and passing through each of said spacers in succession in said column, each of said spacers being disposed between two adjacent rows, said spacers spacing adjacent horizontally extending rows from one another when said panel is in a raised position;

said panel being formed into a plurality of folded sections when raised, each section having an upper portion and a lower portion which are joined together along a depending fold, each upper portion of each section being secured to the lower portion of the folded section immediately thereabove along an interior fold line formed along an associated horizontal row of attached one ends of said spacers, whereby said upper portion and said lower portion of each section are otherwise spaced from said spacers.

7. A shade comprising:

a flexible panel having a top edge, a bottom edge and a back side;

means for securing said top edge of said panel to an upper portion of a frame;

a plurality of connectors having apertures secured to said back side of said panel, said connectors being arranged in an array to form a plurality of generally metrically extending columns and a plurality of generally horizontally extending rows;

a plurality of lines, each of said columns having one line associated therewith, each of said lines being connected to the back side of said panel near its bottom edge and passing through each of the apertures of said connectors in succession in its associated column; and a plurality of spacer means, each spacer means having a predetermined length and being associated with one of said lines passing freely therethrough, each of said spacer means being disposed between an associated pair of adjoining connectors in one of said columns for spacing said adjoining pair of connectors from one another when said panel is in a raised position, each of said spacer means comprising a hollow tube through which an associated one of said lines passes, each of said tubes having a flange disposed on an outer surface thereof, the outer diameter of said flange being no less than the diameter of the apertures formed in said associated pair of connectors.

8. A shade comprising:

a flexible panel having a top edge, a bottom edge and a back side;

means for securing said top edge of said panel to an upper portion of a frame;

a plurality of connectors having apertures secured to said back side of said panel, said connectors being arranged in an array to form a plurality of generally vertically extending columns and a plurality of generally horizontally extending rows, each of said connectors comprising a ring having an aperture disposed therein having an inner diameter;

a plurality of lines, each of said columns having one line associated therewith, each of said lines being connected to the back side of said panel near its bottom edge and passing through each of the apertures of said connectors in succession in its associated column; and a plurality of spacer means, each spacer means having a predetermined length and being associated with one of said lines passing freely therethrough, each of said spacer means being disposed between an associated pair of adjoining connectors in one of said columns for spacing said adjoining pair of connectors from one another when said panel is in a raised position, each of said spacer means comprising a hollow tube having a central conduit through which an associated one of said lines passes, said tube having an outer diameter no less than the inner diameter of said aperture of said ring.

* * * * *